United States Patent [19]

Menchetti et al.

[11] Patent Number: 5,058,355

[45] **Date of Patent: * Oct. 22, 1991**

[54] PANELS WITH LAMINATED STRIPS FOR CLIPS

[75] Inventors: Robert J. Menchetti, Buffalo; Robert M. Chapman, Tonawanda; Matthew J. Kessler, Lancaster, all of N.Y.

[73] Assignee: National Gypsum Company, Dallas, Tex.

[ * ] Notice: The portion of the term of this patent subsequent to Dec. 11, 2007 has been disclaimed.

[21] Appl. No.: 550,262

[22] Filed: Jul. 9, 1990

Related U.S. Application Data

[63] Continuation-in-part of Ser. No. 410,449, Sep. 21, 1989, Pat. No. 4,995,215, which is a continuation-in-part of Ser. No. 299,200, Jan. 23, 1989, Pat. No. 4,976,083.

[51] Int. Cl.[5] ..... E04B 2/58

[52] U.S. Cl. ..... 52/486; 52/489; 52/511

[58] Field of Search ..... 52/481, 486, 489, 511; 156/324.4

[56] References Cited

U.S. PATENT DOCUMENTS

| | | | |
|---|---|---|---|
| 2,281,519 | 4/1942 | Faber | 52/489 X |
| 3,025,650 | 3/1962 | Nelsson | 52/489 X |
| 3,575,750 | 4/1968 | Sakamoto | 156/324.4 X |

FOREIGN PATENT DOCUMENTS

| | | | |
|---|---|---|---|
| 2718463 | 11/1978 | Fed. Rep. of Germany | 52/483 |

*Primary Examiner*—John E. Murtagh
*Assistant Examiner*—Deborah McGann Ripley
*Attorney, Agent, or Firm*—Laird F. Miller; Robert F. Hause

[57] ABSTRACT

A gypsum wallboard suspension system in which the wallboard has a tear-resistant material partially adhered to the back face, with small slots in the material located at unadhered areas, through which small suspension clips are inserted. The clips include a hanger leg for hanging the clip on horizontal channels, which are part of the wall framing system.

15 Claims, 7 Drawing Sheets

PANELS WITH LAMINATED STRIPS FOR CLIPS

This application is a continuation-in-part of a copending application, Ser. No. 07/410,449, filed Sept. 21, 1989, now U.S. Pat. No. 4,995,215, issued Feb. 26, 1991, which is a continuation-in-part of copending application Ser. No. 07/299,200, filed Jan. 23, 1989, now U.S. Pat. No. 4,976,083, issued Dec. 11, 1990.

FIELD OF THE INVENTION

The present invention relates to a demountable wall panel, to a hollow, demountable wall made therefrom, to a method of mounting wallboard, and more particularly to a predecorated wallboard having adhered on the wallboard back face a thin sheet of relatively tear-resistant material with a plurality of openings in the tear-resistant material located at unadhered areas, for the reception of small rigid clips which provide the means for affixing the wallboard to the wall framing system.

BACKGROUND OF THE INVENTION

A common method of affixing demountable predecorated gypsum wallboard to a metal framework, in constructing a hollow interior partition wall, is disclosed in U.S. Pat. No. 4,245,448, wherein a small metal plate with bent-out, sharp, piercing tangs is affixed to a wallboard back face by driving the tangs through the wallboard back face paper, into the interior gypsum core, in a manner similar to a gang nail plate being affixed to a wooden rafter.

These gang nail plates are somewhat expensive, they must be handled separately and delivered to the building contractor separately, they must be affixed to the wallboard by the builder as a separate time consuming step, and their use involves the possibility of the builder applying the clips in the wrong position or in a manner which damages the wallboard. Once affixed to a wallboard, the plates create a problem, by their thickness, rigidness and small size, when a large number of such wallboards are demounted and stacked prior to reconstructing the wall in a new location, since the plates tend to damage wallboards when stacks are high enough to place great weight on the boards near the bottom of the stack.

U.S. Pat. No. 1,810,597 discloses an elongate metal strip which is attached, by tangs or nails or screws, to the back face of a wallboard in a factory. The metal strip includes a plurality of tongues which extend outward in position to cooperate with a plurality of openings in the face of a specially adapted metal stud.

This metal strip is also somewhat expensive, and presents the problem of damage possibly occurring to the wallboard as the strip is being fastened to the wallboard. This strip would also create a problem in stacking the boards, after manufacture in the factory, or after demounting of the wallboards for relocating the wall, due to the protruding tongues.

SUMMARY OF THE INVENTION

The present invention involves a gypsum wallboard which has thin, flexible, tear-resistant material adhesively affixed to the wallboard back face. This thin material, which is preferably a laminated material consisting, for example, of a continuous fiber reinforced paper and a thin, open meshed scrim, is adhered to the back face with a plurality of openings at preplanned positions, for the reception of small, angled, support clips. The clips have at least one upwardly extending leg for disposition through one of the openings and at least one outwardly and downwardly extending leg for placement over a wallboard supporting element of the wall framework, such as a horizontal channel. The clips also, preferably, include an intermediate leg which adjoins the upwardly extending leg and the outwardly and downwardly extending leg and results in the outwardly and downwardly extending leg being disposed adjacent the midsection of the upwardly extending leg. The clips are preferably formed of a rigid sheet metal which has an enlargement in a small area of the top of the intermediate leg and a complementary depression or hole in the immediately adjacent area of the upwardly extending leg, between which depression and enlargement the tear-resistant material is pinched and firmly grasped.

In another embodiment, the clips are preferably formed of a rigid sheet metal with a pair of upwardly extending legs for disposition through a pair of openings, and, in addition to the one outwardly and downwardly extending leg, the clips include a pair of downwardly extending legs which are also for disposition through the same pair of openings.

The thin, flexible, tear-resistant material can be applied in any number of pieces; for examples, it can be applied as one piece to the entire back face of the wallboard, it can be applied as small patches at desired locations on the back face, but it is preferably applied in narrow strips, preferably extending lengthwise of the wallboard closely adjacent each side edge of the wallboard, but alternatively extending laterally at a plurality of spaced locations.

It is an object of the invention to provide a novel combination of elements for affixing wallboard to a wall framing system.

It is a further object to provide a combination of a wallboard with a slit fabric adhered to the back and a rigid clip formed to fit through the fabric slits and have an opposite end which is formed to be supported on a horizontal framing member.

It is a still further object to provide a demountable hollow wall in which wallboard is supported on a metal framework by rigid clips which have an outer portion supported on a horizontal framing member and an inner portion extending through slits in a tear-resistant fabric material adhered to the wallboard back face.

BRIEF DESCRIPTION OF THE DRAWINGS

These and other objects and advantages of the invention will be more readily apparent when considered in relation to the preferred embodiments, as set forth in the specification, and shown in the drawings, in which.

DESCRIPTION OF THE PREFERRED EMBODIMENTS

Figure 1:
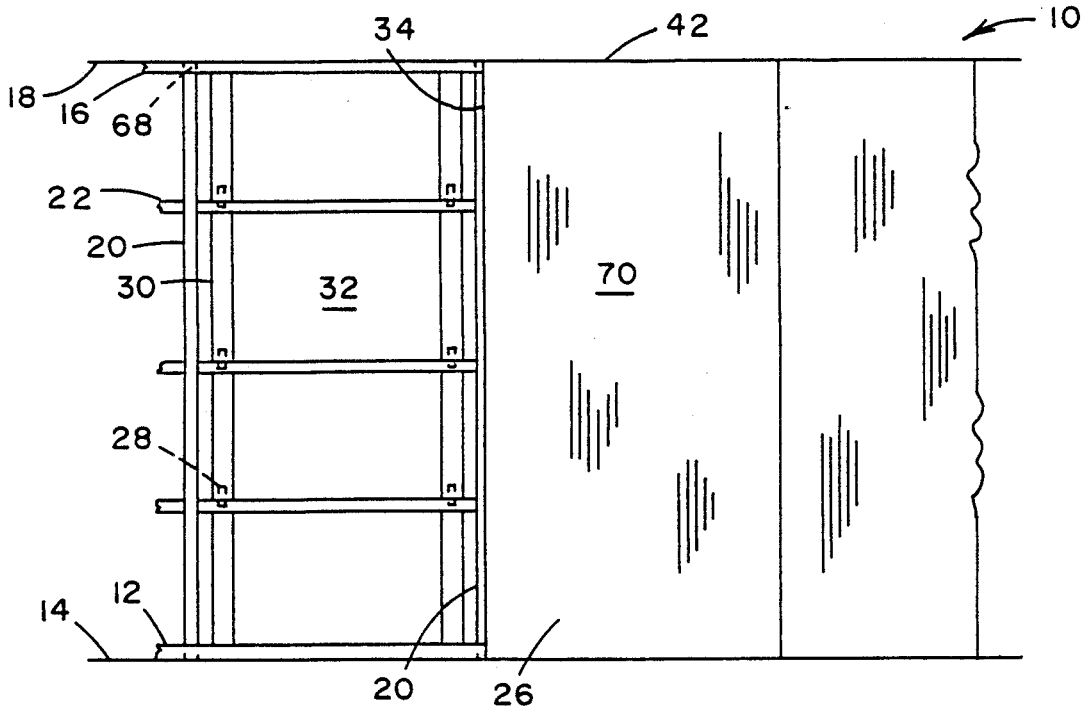
FIG. 1 is a fragmentary elevation of a wall with some of the panels removed to show the framework and wallboard supporting element, all in accordance with the present invention.
Figure 4:
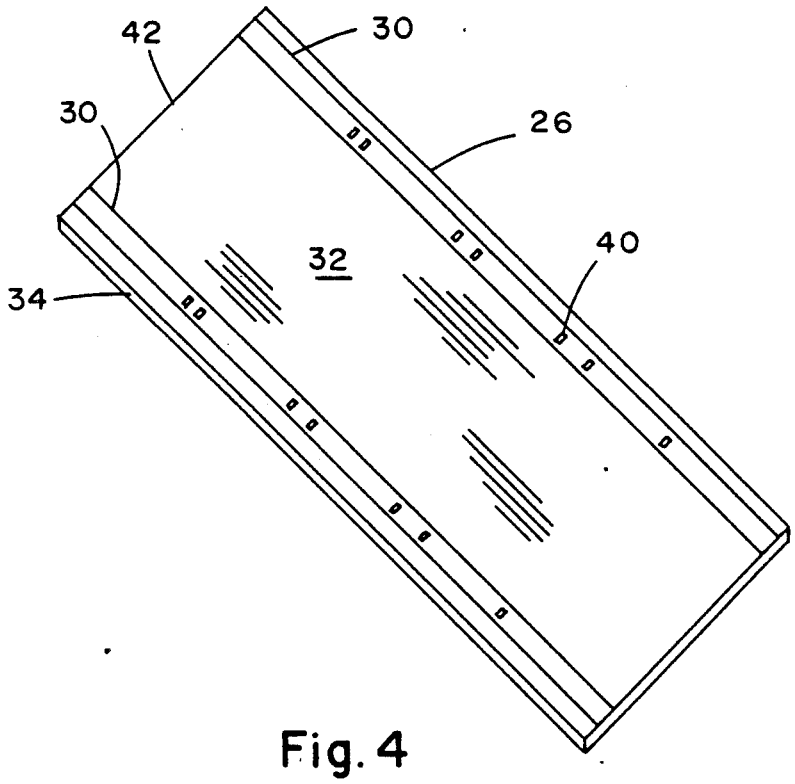
FIG. 4 is an isometric view of the wallboard of FIG. 1 showing the preferred arrangement of fabric strips with a plurality of optional clip receiving slits for use with various ceiling height partition walls.
Figure 2:
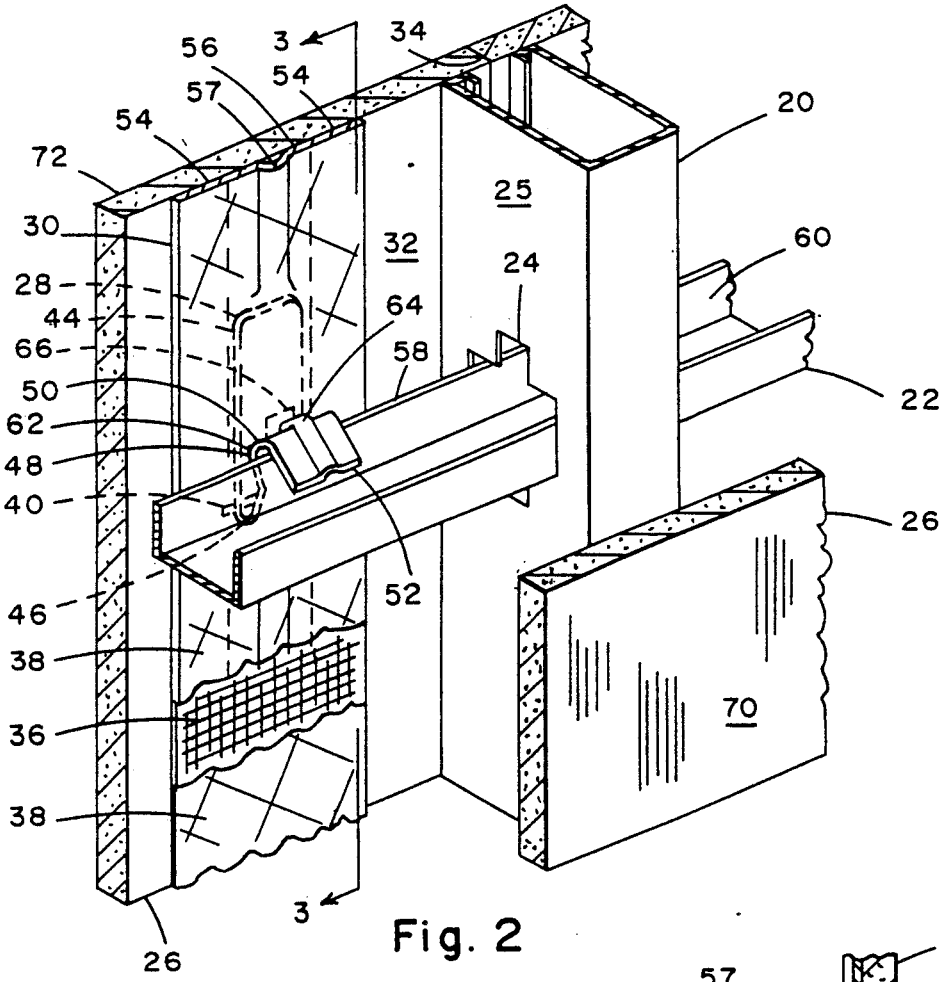
FIG. 2 is a partly broken away, isometric view of a small section of the wall of FIG. 1, showing the wallboard supporting elements.
Figure 3:
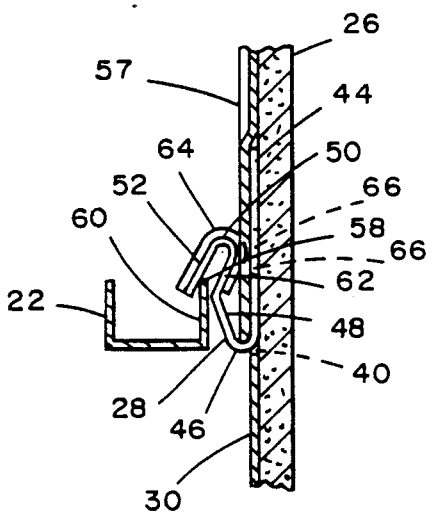
FIG. 3 is a vertical sectional view of the wallboard supporting elements of FIG. 2 taken on line 3—3 thereof.

Referring to the drawings, there is shown a wall 10 including a floor runner 12 mounted on floor 14, a ceiling runner 16 mounted on ceiling 18, vertical, laterally-spaced studs 20 mounted in the floor runner 12 and ceiling runner 16, vertically-spaced horizontal channels 22 extending through horizontally aligned cutouts 24 in the webs 25 of the studs 20, and wallboards 26 which are mounted firmly against both sides of the studs 20, held there by suspension clips 28. Wallboards 26 are preferably paper covered gypsum wallboards.

The wallboards 26 have a novel tear-resistant, slotted, elongate fabric strip 30 partially adhered to the back face 32 adjacent each side edge 34 of each wallboard 26. Tear-resistant strips 30 can be formed of any thin, strong material, but are preferably formed of a thin, laminated composite including a fabric scrim 36 having square-woven, tension-resistant fiberglass threads, eight threads per inch, with threads extending laterally and longitudinally of the elongate strip 30 laminated on each face to fiber-reinforced papers 38, 38 in which the fibers are tension-resistant fiberglass threads arranged in both diagonal directions of the strip 30, spaced apart at about one-half inch spacings. The fiber-reinforced paper 38 may be made from fiber-reinforced paper tapes which are commonly used in wrapping and sealing large packages.

It is also contemplated that the tear-resistant strips 30 can be formed of other thin, strong materials, including a non-woven, fused, composite layer of a synthetic fiber such as a polyester or polypropylene combined with wood pulp fibers which layer is laminated to a relatively unstretchable 40 to 50 pound Kraft paper; a similar composite layer without the Kraft paper; a non-woven, fused layer of a synthetic fiber such as polyester or polypropylene without wood pulp but laminated to a Kraft paper; a non-woven, fused layer of synthetic fibers such as polyester or polypropylene combined with wood pulp fibers and with fiberglass fibers; any of the above-mentioned layers in which the synthetic fibers have been spun-bonded; any of the above-mentioned layers in which fiberglass fibers with a suitable binder are substituted for the synthetic fibers; any of the above-mentioned layers with a further layer of a woven scrim added to the layer or laminated between two such layers; spun-bonded, non-woven nylon; latex impregnated paper laminated to a Kraft paper; metal screen laminated to a Kraft paper; or a thin metal sheet, such as steel, of about 0.015 inch thickness. In the case of the non-woven examples, the non-woven materials will preferably be of about 3 to 4 ounces per square yard and about 0.018 to 0.023 inch thick. It is contemplated that many other equivalent thin tear-resistant materials may be found suitable for use in accordance with the invention.

The strips 30 can be made from any thin sheet material of any number of plies if sufficient tear resistance can be provided to support the wallboards 26, as will be understood from the following description of the function of the strips 30.

The strips 30, in the preferred embodiment, are about two inches to four inches wide, and are partially adhesively affixed along the full length of the back face 32. One strip 30 is placed parallel to and spaced inward from one side edge 34 and a second strip 30 is placed parallel to and spaced inward from the opposite side edge 34.

The strips 30 have a plurality of slots 40 extending laterally, having a lateral length of about one inch and a slot width of between about 0 and ¼ inch. The slots 40 are centered laterally of the strips 30 and are spaced apart at a distance which will correspond to the vertical spacing of the horizontal channels 22 of wall 10.

The slots 40 are preferably formed in the strips 30 prior to adhering the strips to the back face 32, however, it is contemplated that the slots 40 could be formed subsequent to adhering the strips 30 to back face 32, even as late as just prior to mounting the wallboards 26, to construct the wall 10.

In the prior construction of partition walls involving suspending wallboard on spaced parallel horizontal channels, such as the structure of the previously discussed U.S. Pat. No. 4,245,448, it has been the practice to employ four horizontal channels at twenty-four-inch spacings, for ten-foot high walls, and three horizontal channels at twenty-six-inch spacings, for nine-foot high walls, measuring the first spacing from the ceiling, or top edge of a wallboard to the bottom of the first channel. Accordingly, the slots 40 in strips 30 are located at spacings from the wallboard top edge 42 of 24 inches, 26 inches, 48 inches, 52 inches, 72 inches, 78 inches, and 96 inches.

The suspension clips 28, which hold the wallboard 26 against the studs 20, are formed of a heavy gauge, one-inch wide sheet metal and include a three-inch long, vertically extending back leg 44 connected at the bottom with a 170° bend 46 to an upwardly extending curved, inch-and-a-half long front leg 48. Front leg 48 is connected at the top with a 150° bend 50 to a downwardly and outwardly extending hanger leg 52, which extends at an angle of about 40° to 60° relative to the vertical back leg 44.

The tear-resistant strips 30, which are partially adhered to the back face 32 of wallboards 26, are adhered very firmly along the two side edge areas 54 with no adhesion of the strips 30 along an elongate central area 56, which central area 56 is substantially equal in width to the laterally extending length of the slots 40. Strips 30 have a raised ridge 57 along the center of central area 56, providing easier insertion of clips 28 through slots 40, as described herebelow.

The back leg 44 of each clip 28 is disposed between the wallboard back face 32 and the tear-resistant strip 30. Each clip 28 extends through a slot 40 at the clip bottom bend 46. Each clip hanger leg 52 is disposed over the top edge 58 of an upwardly extending side wall 60 of a horizontal channel 22.

FIG. 1 shows a nine-foot high wall 10, with three channels 22 spaced respectively 26 inches, 52 inches and 78 inches downward from the wallboard top edge 42, and with three clips 28 having clip bottom bends 46 extending through slots which are also spaced respectively 26 inches, 52 inches and 78 inches downward from the wallboard top edge 42. The wallboards 26 are, thus, each suspended, and urged firmly against the studs 20, by the hanger legs 52, of six clips 28, being supported on the channel side walls 60 and the tear-resistant strips 30 being supported, at the six slots 40 engaged by clips 28, by the tear-resistant strength of the material of strips 30.

The weight of the wallboards 26 is also partially supported by the grasping forces created by the hanger legs 52, which are being bent upward by the weight of the wallboard 26, causing the upper end 62 of curved front leg 48 to be urged firmly against the strip 30, squeezing the strip 30 between the upper end 62 and the back leg 44. To further enhance this grasping, the hanger leg and the upper end 62 of the front leg have a central raised ridge 64, and back leg 44 has a small hole 66 located so that the portion of ridge 64 which extends around bend 50 will protrude slightly into the hole 66 when the front leg 48 is urged rearward against back leg 44, resulting in essentially a locking force grasping the material of strip 30 located therebetween.

It will be understood that if wall 10 were to be a ten-foot high wall, there would be one additional channel 22 and two additional clips 28, all disposed respectively at locations 24 inches, 48 inches, 72 inches and 96 inches from the wallboard top edge 42. Wallboard top edge 42 will be seen to be at the same height as the stud top edges 68, which are disposed within the ceiling runner 16.

If the wallboards are four-feet wide, there will commonly be an additional vertical stud (not shown) located at two-foot spacings from the studs 20 at the wallboard side edges 34. In such cases, it is common to have the wallboard side edges 34 of one face 70 of the wall 10 located over alternating studs 20, between the studs (not shown) behind the wallboard edges of the other face 72 of the wall 10.

Figure 5:
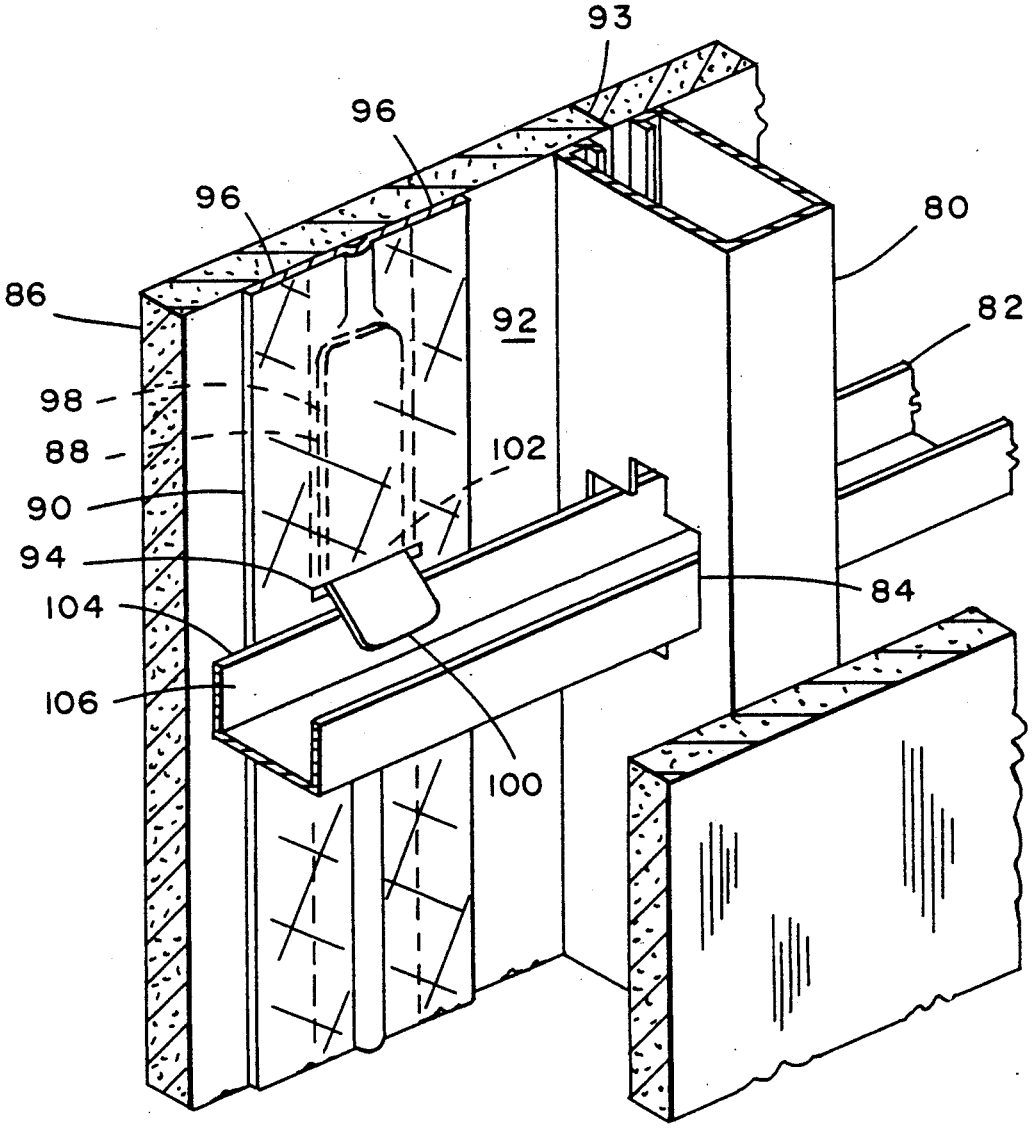
FIG. 5 is a partly broken away, isometric view, similar to FIG. 2, of a modified form of the invention.

In FIG. 5, there is shown a modified form of the invention in which a stud 80 supports a horizontal channel 82 extending through cutouts 84 in the stud 80. Wallboards 86 are supported and held firmly against studs 80 by suspension clips 88. The wallboards 86 have a tear-resistant fabric strip 90 partially adhered to the back face 92, adjacent each side edge 93 of wallboard 86.

The fabric strip 90 has a plurality of slots 94 extending laterally and centered laterally in the strip 90, which is adhered to the wallboard 86 along side edge areas 96.

The suspension clips 88 are formed of a heavy gauge, one-inch wide sheet metal and include a three-inch long, vertically extending top leg 98, connected at the bottom 102, to a hanger leg 100, which extends outwardly and downwardly from the bottom 102 of top leg 98, at an angle of about 40° to 60°, relative to the vertical top leg 98.

The top leg 98 of each clip 88 is disposed between the wallboard back face 92 and the strip 90. Each clip extends through a slot 94 at the bottom 102 of top leg 98. Each clip hanger leg 100 is disposed over the top edge 104 of an upwardly extending side wall 106 of a horizontal channel 82.

Figure 6:
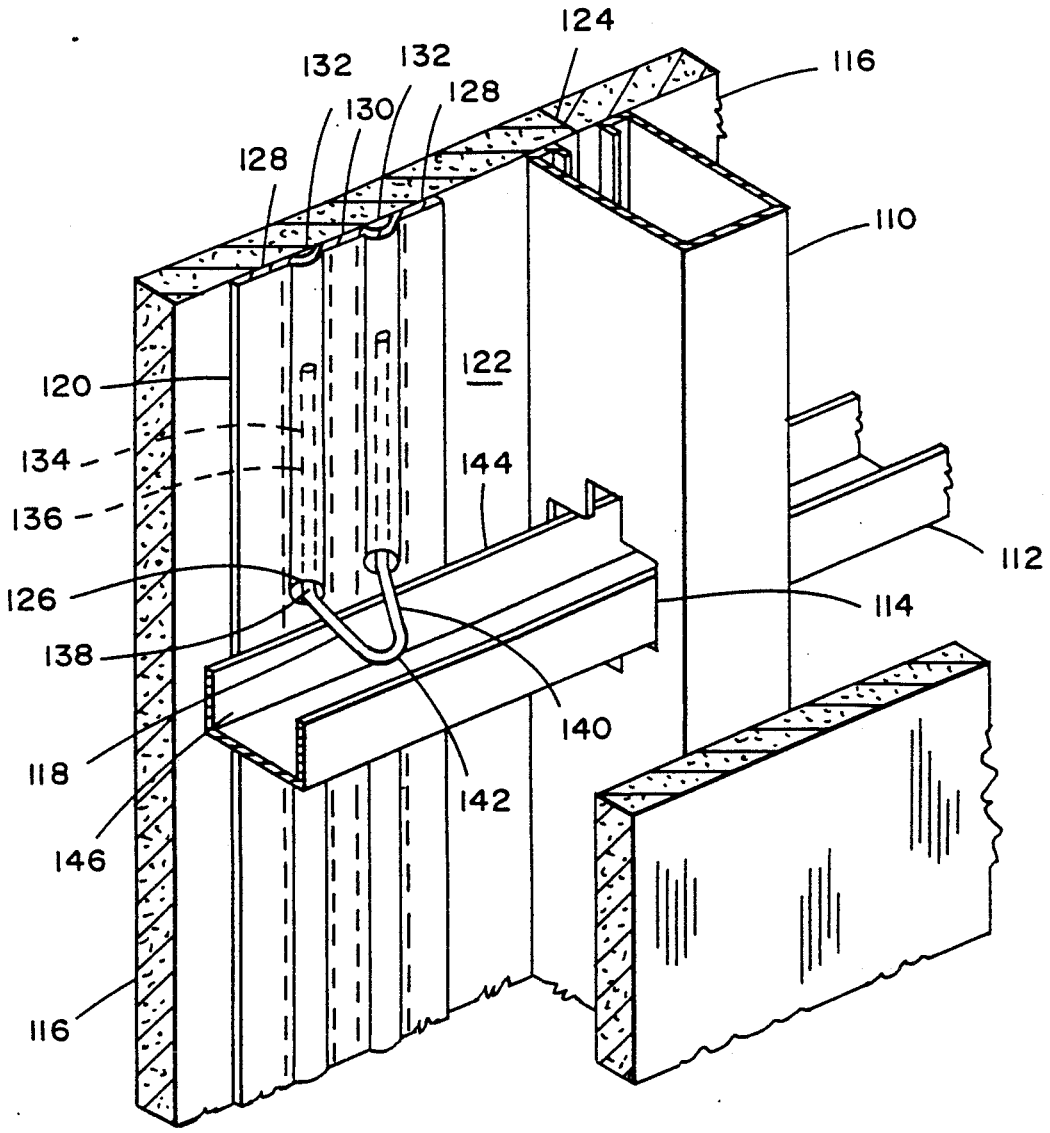
FIG. 6 is a partly broken away, isometric view, similar to FIG. 2, of a further modified form of the invention.

In FIG. 6, there is shown a still further modified form of the invention in which a stud 110 supports a horizontal channel 112 extending through cutouts 114 in the stud 110. Wallboards 116 are supported and held firmly against studs 110 by wire suspension clips 118. The wallboards 116 have a tear-resistant fabric strip 120 partially adhered to the back face 122, adjacent each side edge 124 of wallboards 116.

The fabric strip 120 has a plurality of small holes 126 arranged in laterally spaced pairs in the strip 120, which is adhered along side edge areas 128 and in a center area 130, leaving unadhered narrow areas 132 between the center area 130 and each side area 128.

The wire suspension clips 118 are formed of a heavy, rigid wire of two symmetrical side portions 134. Each side portion 134 includes a three-inch long, vertically extending top leg 136 connected at the bottom 138 to a hanger leg 140, which extends outwardly and downwardly from the bottom 138 of top leg 136, at an angle of about 40° to 60° relative to the vertical top leg 136. The hanger legs 140 of each side portion 134 are joined together at a bottom wire bend 142.

The top leg 136 of each side portion 134 of each clip 118 is disposed between the wallboard back face 122 and the strip 120, at an unadhered narrow area 132. Each side portion extends through one of the pair of small holes 126, at the bottom 138 of the top leg 136. The pair of hanger legs 140 are disposed over the top edge 144 of an upwardly extending side wall 146 of a horizontal channel 112.

In addition to the embodiments described, which incorporate an elongate tear-resistant fabric strip 30, 90 or 120, extending lengthwise on the back face 32, 92 or 122 of wallboard 26, 86 or 116, it is contemplated that at least one piece of tear-resistant material be used which could be elongate strips extending laterally across the width of the board at desired spaced locations, or, even further, the tear-resistant material could be discontinuous strips or patches. With laterally extending strips, slots, for insertion of clips 28, 88 or 118, would need to be located inward from the bottom and top edges, with unadhered areas of tear-resistant material above the slots, between adhered areas of material. The width of a laterally extending strip may need to be wider than what is required for longitudinally extending strips.

FIGS. 7–18 show an even further modified form of the invention in which a stud 150 supports a horizontal channel 152 extending through cutouts 154 in the stud 150. Wallboards 156 are supported and held firmly against studs 150 by suspension clips 158. The wallboards 156 have a tear-resistant, fibrous strip 160 partially adhered to the back face 162, adjacent each side edge 163 of wallboard 156.

Figure 7:
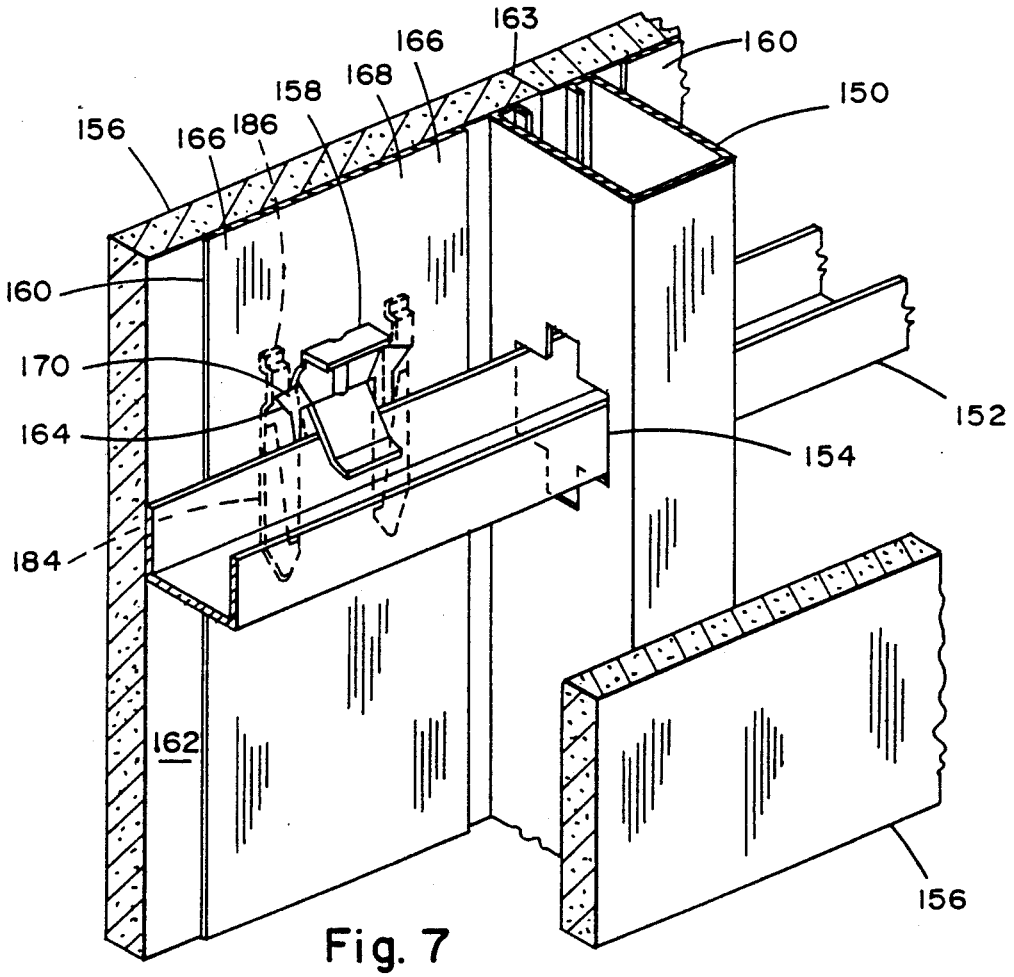
FIG. 7 is a partly broken away, isometric view, similar to FIG. 2, of a still further modified form of the invention.
Figure 8:
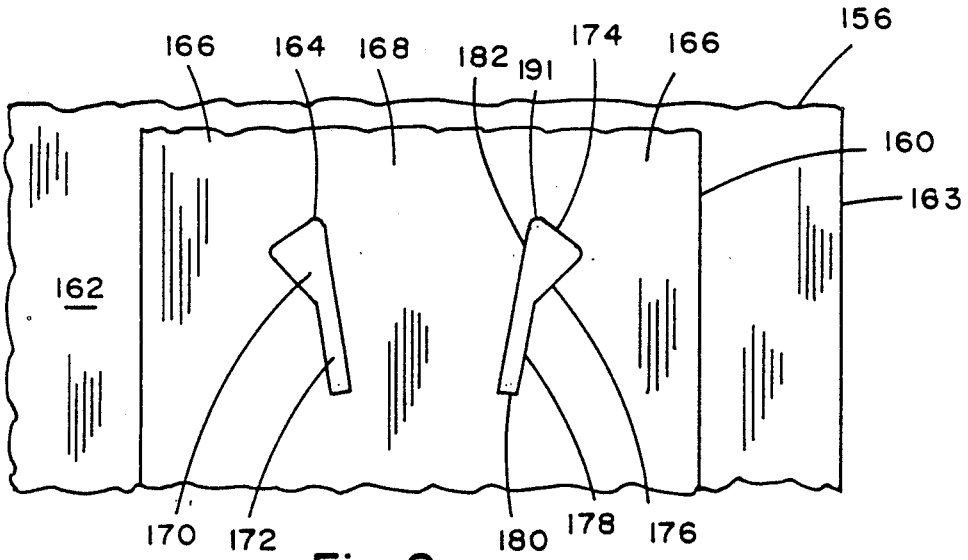
FIG. 8 is a back view of the wallboard of FIG. 7, showing the tear-resistant strip with P-shaped slots.
Figure 12:
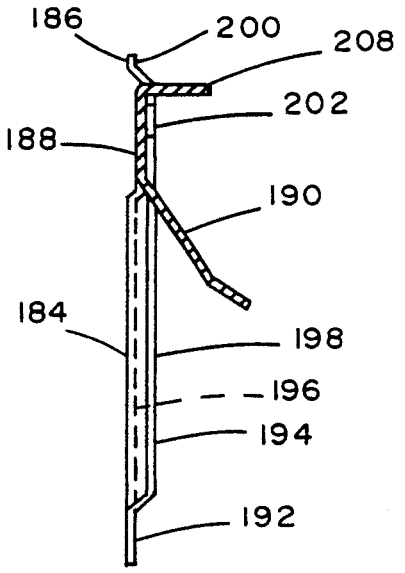
FIG. 12 is a side sectional view of the clip of FIG. 7 taken on line 12—12 of FIG. 9.
Figure 10:
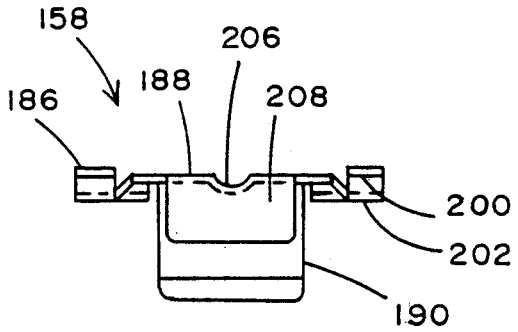
FIG. 10 is an end view of the clip of FIG. 7.
Figure 11:
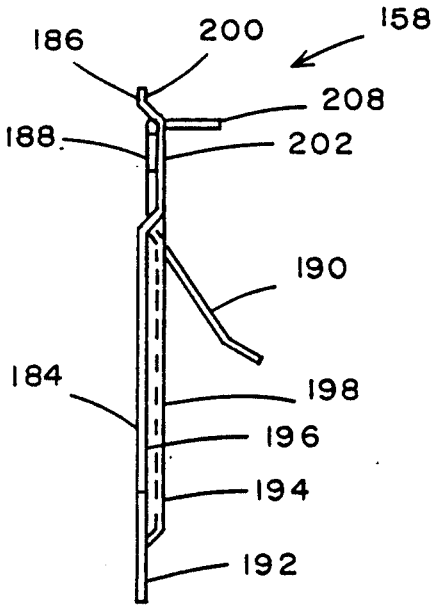
FIG. 11 is a side view of the clip of FIG. 7.
Figure 9:
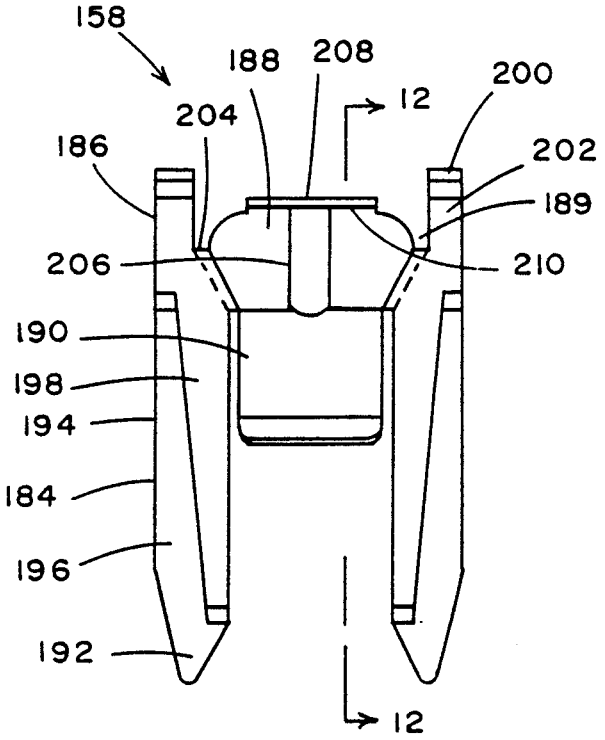
FIG. 9 is a face view of the clip of FIG. 7.
Figure 16:
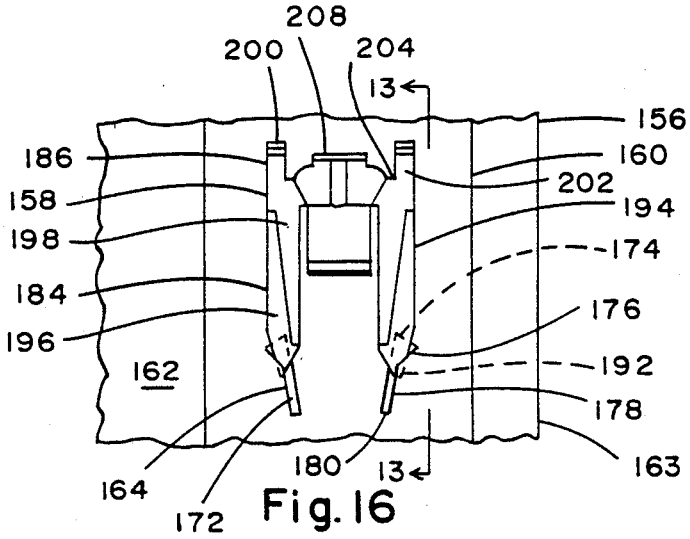
FIGS. 16–18 are face views of the clip and wallboard, corresponding to the positions of the clip in FIGS. 13–15.
Figure 13:
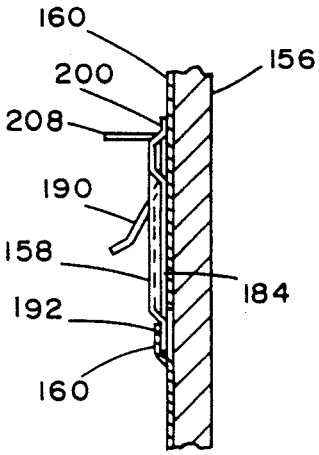
FIG. 13 is a side sectional view of the wallboard of FIG. 7 with the clip bottom being inserted into one of the P-shaped slots.

The fibrous strip 160 has a plurality of pairs of P-shaped openings or slots 164 arranged in pairs, one pair of slots 164 being shown in FIG. 7. The fibrous strip 160 is adhered to the wallboard back face 162 along side edge areas 166 of the strip 160, leaving a central area 168 disposed against wallboard back face 162, but not adhered thereto.

Each of the P-shaped slots 164 includes a triangular upper opening 170 and a narrow rectangular downwardly extending lower opening 172, with each slot 164 having a perimeter of five edges, namely the outward and downward top edge 174, the inward and downward center outer edge 176, the outer lower opening edge 178, the bottom short lower opening edge 180, and the slot inner edge 182, forming the inner edge of both the lower opening 172 and the upper opening 170. Inner edge 182 extends upwardly and slightly outwardly from the bottom edge 180. The two slots 164 of each pair, only one pair being shown, are located in the unadhered central area very near the adhered side edge areas 166, with the top edge 174 and the center edge 176 of each slot 164 meeting very near the adjacent adhered side edge area 166, preferably about 1/5 inch from the adhered area 166.

The suspension clips 158 are formed of a heavy gauge, formed sheet metal and include a pair of downwardly directed, sidewardly disposed, long legs 184, a pair of upwardly directed, sidewardly disposed, short legs 186, said two long legs 184 and two short legs 186 all being adjoined to a central body portion 188. Extending downwardly and outwardly from body portion 188 is a hanger leg 190, which extends at an angle of about 40° to 60° relative to the plane of the body portion 188. Body portion 188 adjoins short legs 186 forming a downwardly pointed U-shaped channel 189 which abuts the corner 191 formed by the opening top edge 174 and inner edge 182.

Referring to FIGS. 9–12, the somewhat complex shape of the formed sheet metal clip 158 will be more clearly understood, particularly when further considering the method by which the clip is inserted into the P-shaped slots 164 as shown by the steps set forth in FIGS. 13–18.

Insertion of each clip 158 into P-shaped slots 164 involves, first, the downward insertion of legs 184 under the center outer edge 176 and thence on down into the narrow rectangular lower opening 172.

The legs 184 will be seen to each have a flat lower tip 192 and an upper portion 194 which has two levels. The upper portion 194 has an outer edge portion 196 in the plane of the lower tip 192 and an inner edge portion 198 which is raised about ⅛ inch. The short legs 186 each have a small flat tip 200, in the plane of lower tip 192, and immediately therebelow a raised portion 202, connected to and in the same plane as inner edge portion 198.

As a result of this structure, the lower tip 192 is in a plane suitable for easy initial insertion under center outer edge 176, but as long legs 184 are moved further down into opening 172, the raised inner edge 198 raises the fibrous strip 160 away from the wallboard back face 162.

Figure 17:
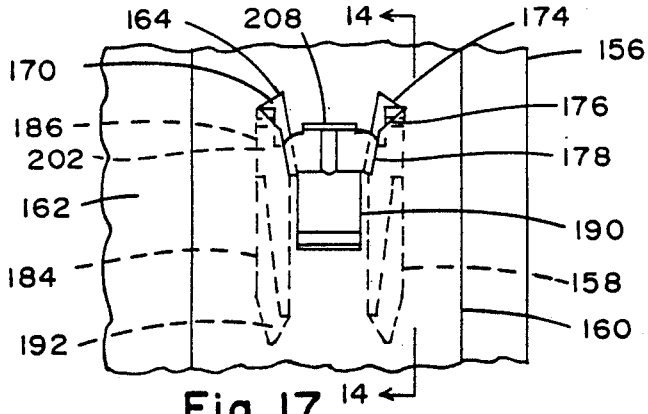
Figure 14:
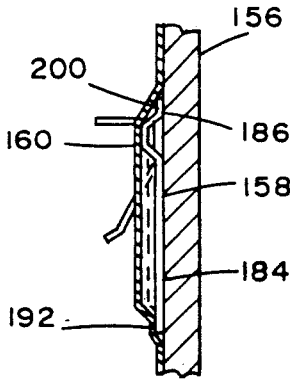
FIG. 14 is a side sectional view similar to FIG. 13 with the clip fully inserted downwardly into the P-shaped slot.
Figure 18:
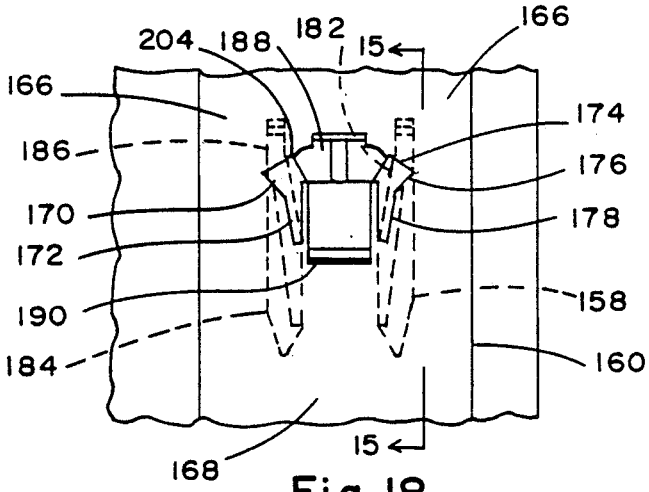
Figure 15:
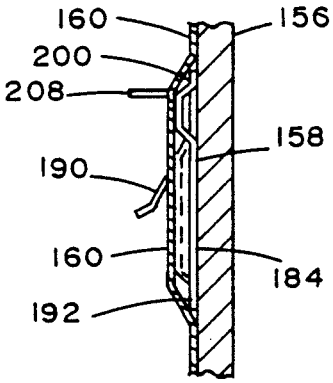
FIG. 15 is a side sectional view similar to FIG. 13 with the clip moved upwardly to its final operational position.

As seen in FIG. 17, the clip 158 is moved downward into the slots 164 until the raised portion 202 of the upwardly directed short legs 186 are under the outer edge 176, raising the fibrous strip 160 even further from the wallboard back face 162, whereby the top edge 174 is now raised away from the wallboard back face 162.

The clip 158 is then moved upward, and, with the top edge 174 raised, the short legs 186 easily move under the top edges 174 of each slot 164. The clip 158 is moved as far up as possible, until the junction 204, where the short legs 186 and the clip central body portion 188 are joined, engages the uppermost extent of the P-shaped slots 164, at the corner 191 formed between the top edge 174 and the inner edge 182.

The body portion 188 is in a plane very close to the plane of the leg tips 192 and 200, pressing against the fibrous strip 160. A vertically extending raised ridge 206 in the center of the body portion 188 provides stiffness to the body portion 188. An outwardly extending large tab 208 extends outward from the top edge 210 of body portion 188, providing a means for holding clip 158 and for moving it downward and then upward.

The hanger leg 190 will be seen in FIG. 7 to extend over the horizontal channel 152, to support the wallboard 156.

In the preferred form of the invention of FIGS. 7–18, the P-shaped slots 164 are about 1¼ inches long and about ½ inch wide. The clip long legs 184 are about 2½ inches long, with an overall length of clips 158 of about 3½ inches. The hanger leg is about one inch wide and close to 1½ inches long.

The weight of the wallboard 156 is supported by the clip 158, which creates a substantial amount of tension in the strip 160, primarily parallel and adjacent the top edge 174 and the inner edge 182. The relatively long downwardly directed legs 184 permit a relatively long extent of adhered side edge area 166 to act to resist any rotation of the clip 158.

Having completed a detailed disclosure of the preferred embodiments of our invention, so that others may practice the same, we contemplate that variations may be made without departing from the essence of the invention.

We claim:

1. In combination, a wallboard comprising at least one piece of thin, strong, tear-resistant material partially adhered to a back face of said wallboard, and at least one suspension clip, said piece of tear-resistant material having at least one pair of laterally spaced openings, said tear-resistant material being firmly adhered to said back face in areas closely adjacent said openings, said tear-resistant material being unadhered to said back face in areas located behind and immediately above said openings, forming pockets in said areas located behind and immediately above said openings, said suspension clip having a pair of spaced, parallel legs extending vertically upwardly respectively through each of said pair of laterally spaced openings in said tear-resistant material and upwardly into said pockets between said unadhered areas and said back face, said suspension clip further having an outwardly and downwardly extending hanger leg for suspending said wallboard from a horizontal member of a wall framing structure.

2. The combination of claim 1 wherein said tear-resistant material comprises a strong woven material.

3. The combination of claim 1 wherein said tear-resistant material comprises a fiber-reinforced paper.

4. The combination of claim 1 wherein said tear-resistant material is an elongate narrow strip extending closely adjacent a side edge of said wallboard back face, said strip of a plurality of said pairs of openings.

5. The combination of claim 1 wherein said suspension clip further comprises at least one relatively long downwardly extending leg.

6. The combination of claim 1 wherein said suspension clip further comprises a pair of relatively long downwardly extending legs.

7. The combination of claim 6 wherein said tear-resistant material is unadhered to said back face in areas located behind and immediately above and immediately below said openings, forming pockets in said areas located behind and immediately above and immediately below said openings and wherein said pair of downwardly extending legs are disposed within said pockets immediately below said openings.

8. The combination of claim 7 wherein said pair of upwardly extending legs, said pair of downwardly extending legs and said hanger leg are all adjoined to a central body portion.

9. The combination of claim 7 wherein said downwardly extending legs have lower tips which are in a plane abutting said wallboard back face and said downwardly extending legs have an upper portion which is at least partially in a plane spaced about ⅛ inch away from said wallboard back face whereby said downwardly extending legs can be inserted first through said openings and said upper portion will raise said tear-resistant material causing widening of said opening to permit easier subsequent insertion of said upwardly extending legs.

10. The combination of claim 9 wherein said openings are somewhat P-shaped, each including a relatively large upper opening portion and a relatively narrow lower opening portion, said opening being sufficiently large to permit an initial insertion of an upwardly extending leg subsequent to an insertion of a corresponding downwardly extending leg.

11. The combination of claim 8 wherein said body portion and said upwardly extending legs, where adjoined, form downwardly pointed channels, and wherein said downwardly pointed channels abut a top edge of each of said pair of openings.

12. A unitary suspension clip comprising a central body portion, a pair of relatively long downwardly extending legs at opposite sides of said body portion, a pair of relatively short upwardly extending legs at opposite sides of said body portion and extending upwardly from said downwardly extending legs and an outwardly and downwardly extending hanger leg extending from said body portion, whereby said upwardly extending legs are able to be inserted through a pair of laterally spaced openings in a tear-resistant material partially adhered to a wallboard back face while said body portion remains outside said tear-resistant material to permit the junctions of the short legs with the body portion to engage the top edge of said openings and support said wallboard when said hanger leg is supported on a horizontal framing member and said downwardly extending legs bear against the wallboard back face to prevent rotation of the clip.

13. A unitary suspension clip as defined in claim 12 wherein said relatively long downwardly extending legs each have a lower tip which is in a first plane, said relatively short upwardly extending legs each have an upper flat tip which is also in said first plane and said relatively long downwardly extending legs each have an upper portion which is at least partially in a second plane disposed outwardly from said first plane, whereby said downwardly extending legs can be inserted into a pair of laterally spaced openings in a tear-resistant material partially adhered to a wallboard, and in so doing will raise the partially adhered material, by reason of said upper portion being in an outwardly disposed second plane, thus permitting relatively easy insertion of said upwardly extending legs when said clip has been moved sufficiently far downwardly through said openings.

14. A unitary suspension clip as defined in claim 13 wherein said upwardly extending legs also have a raised portion disposed in said second plane.

15. A unitary suspension clip as defined in claim 13 wherein said portion of said downwardly extending legs which are in said second plane are coextensive with said raised portion of said upwardly extending legs.

* * * * *